US009531048B2

(12) United States Patent
Tavassoli Hozouri

(10) Patent No.: US 9,531,048 B2
(45) Date of Patent: Dec. 27, 2016

(54) MODE FILTER

(71) Applicant: Space Systems/Loral, LLC, Palo Alto, CA (US)

(72) Inventor: Behzad Tavassoli Hozouri, Sunnyvale, CA (US)

(73) Assignee: Space Systems/Loral, LLC, Palo Alto, CA (US)

( * ) Notice: Subject to any disclaimer, the term of this patent is extended or adjusted under 35 U.S.C. 154(b) by 318 days.

(21) Appl. No.: 13/800,365

(22) Filed: Mar. 13, 2013

(65) Prior Publication Data

US 2014/0266961 A1 Sep. 18, 2014

(51) Int. Cl.
*H01P 1/207* (2006.01)
*H01P 1/208* (2006.01)

(52) U.S. Cl.
CPC ..... *H01P 1/208* (2013.01)

(58) Field of Classification Search
CPC ..... H01P 1/207; H01P 1/208
(Continued)

(56) References Cited

U.S. PATENT DOCUMENTS 2,759,156 A 8/1956 Younker
3,184,695 A 5/1965 Unger
(Continued)

FOREIGN PATENT DOCUMENTS

CN 101764273 6/2010
CN 101764275 6/2010
(Continued)

OTHER PUBLICATIONS

Kroll, N.M. et al., "Mode Filter Design for the NLC Overmoded RF Power Transport System", Stanford Linear Accelerator Center; University of California, San Diego, SLAC-PUB-6623, Aug. 1994, 3 pages.

(Continued)

*Primary Examiner* — Stephen E Jones
*Assistant Examiner* — Scott S Outten
(74) *Attorney, Agent, or Firm* — Weaver Austin Villeneuve & Sampson LLP

(57) ABSTRACT

A mode filter provides a low-loss transmission path for RF signals propagating in a first mode, while substantially suppressing at least one second mode. The mode filter includes a proximal port and a distal port, having a respective characteristic cross sectional dimension $D_{p1}$ and $D_{p2}$, and an electrically conductive hollow tube having a longitudinal axis that extends a length L between a distal end of the proximal port and a proximal end of the distal port. A cross section transverse to the longitudinal axis is non-uniform along length L and has a minimum internal characteristic dimension $D_{min}$ at least at a first longitudinal position and a maximum internal characteristic dimension $D_{max}$ at least at a second longitudinal position. The mode filter is configured to suppress the at least one second mode by at least 5 dB, and $D_{max}$ is less than 2.5 times the greater of $D_{p1}$ and $D_{p2}$.

18 Claims, 7 Drawing Sheets

(58) Field of Classification Search
USPC ..... 333/208, 251
See application file for complete search history.

(56) References Cited

U.S. PATENT DOCUMENTS

| | | | | |
|---|---|---|---|---|
| 3,321,720 | A | 5/1967 | Shimada | |
| 3,597,710 | A * | 8/1971 | Levy | H01P 1/211 333/210 |
| 3,732,511 | A | 5/1973 | Den | |
| 3,771,076 | A | 11/1973 | Kidner et al. | |
| 3,771,078 | A | 11/1973 | Kidner et al. | |
| 3,779,805 | A | 12/1973 | Alsberg | |
| 3,787,787 | A | 1/1974 | Shimada et al. | |
| 3,845,422 | A * | 10/1974 | Rhodes | 333/208 |
| 3,916,355 | A | 10/1975 | Inada | |
| 4,222,018 | A | 9/1980 | Watson et al. | |
| 4,238,747 | A | 12/1980 | Harp et al. | |
| 4,344,053 | A | 8/1982 | Anderson | |
| 6,118,978 | A * | 9/2000 | Ihmels | 455/12.1 |
| 6,130,586 | A | 10/2000 | Schulz | |
| 6,285,267 | B1 * | 9/2001 | Hauth et al. | 333/210 |
| 6,535,174 | B2 | 3/2003 | Roa et al. | |
| 7,088,060 | B2 * | 8/2006 | Nakazato | 315/503 |

FOREIGN PATENT DOCUMENTS

| | | |
|---|---|---|
| CN | 201576727 | 9/2010 |
| CN | 201804984 | 4/2011 |
| EP | 0113901 | 7/1984 |
| GB | 1095274 | 12/1967 |
| JP | 59218001 | 12/1984 |
| JP | 8204401 | 8/1996 |
| JP | 11031901 | 2/1999 |

OTHER PUBLICATIONS

Lee, Choon Sae et al., "Normal Modes in an Overmoded Circular Waveguide Coated with Lossy Material", IEEE Transactions on Microwave Theory and Techniques, vol. MTT-34, No. 7, Jul. 1986, 13 pages.

Warters, W.D., "The Effects of Mode Filters on the Transmission Characteristics of Circular Electric Waves in a Circular Waveguide", The Bell System Technical Journal, May 1958 (Manuscript received Nov. 19, 1957), 22 pages.

* cited by examiner

100

MODE FILTER

TECHNICAL FIELD

This disclosure relates to a mode filter, and, more particularly, to a filter for suppressing undesired propagating modes of a microwave signal.

BACKGROUND OF THE INVENTION

The assignee of the present invention manufactures and deploys spacecraft for, inter alia, communications and broadcast services. Payload systems for such spacecraft may include high power microwave radio frequency (RF) components such as travelling wave tube amplifiers (TWTA's) and feed networks that are connected by waveguides to radiating elements such as horn antennas and antenna feed elements.

For any mode of transmission of a microwave signal in a waveguide, the electric and magnetic transverse fields may each be resolved into a respective set of tangential and radial components. For a circular waveguide, for example, the tangential and radial components may vary periodically in amplitude along a circular path which is concentric with the wall of the waveguide and may also vary in amplitude along any given radius in a manner related to a Bessel function of order 'm'. Propagating modes of a transverse electric field are identified by the notation $TE_{mn}$ and propagating modes of a transverse magnetic field are identified by the notation $TM_{mn}$, where m represents the total number of full period variations of either the tangential or radial component of the respective electric or magnetic field, and n represents one more than the total number of reversals of polarity of either the tangential or the radial component of the respective electric or magnetic field along a radial path.

A mode filter that suppresses one or more undesired propagating modes, while passing one or more other propagating modes is useful for various applications. As an example, application of a mode filter, a circular waveguide having a dominant mode denoted as the $TE_{11}$ mode, which corresponds to the $TE_{10}$ mode in rectangular waveguides, may be considered. Waveguides may provide a low-loss transmission path for microwave signals in the dominant $TE_{11}$ for a circular waveguide or $TE_{10}$ mode for a rectangular waveguide. It is often desirable to confine the energy propagated in a waveguide to the dominant mode, particularly near an interface between the waveguide and a radiating feed element or horn antenna. Accordingly, there arises a need to suppress TM modes generally, and higher order TE modes.

Higher order modes may result from use of waveguides having a cross-section that is large relative to a wavelength of the propagated signal, irregularities in the path of the waveguide, and/or lack of symmetries in at least some waveguides. Moreover, in satellite communication systems, at least, it is often necessary to operate the same antenna and associated waveguide at two or more disparate frequency bands. Although, in the lowest of the two or more frequency bands, usually only a single mode can propagate in the waveguide, at the higher frequency bands, other higher propagating modes may exist. This can compromise the radiation pattern of the antenna, particularly in terms of cross polarization.

It is a common practice to utilize four-fold symmetry in the feed networks of such antennas to suppress those unwanted modes. However, this results in expensive and big waveguide structures. Therefore, mode filters are desirable to dampen the aforementioned unwanted modes. Mode filters of various types have proven utility for suppressing higher order modes. Such mode filters are disclosed, for example, in U.S. Pat. Nos. 4,222,018, 4,238,747, 4,344,053, and 6,130,586, the disclosures of which are hereby incorporated in their entirety into the present application.

While the mode filters disclosed in the above identified patents may have utility for suppressing higher order modes, the previously disclosed mode filters, in contrast to the present invention, represent a compromise between mechanical and electrical performance. For example, some prior art filters may provide good mode suppression but are relatively bulky, are made of multiple parts, and may be difficult to manufacture and/or integrate. At least some mode filters of the prior art require tuning, and/or provide only narrow band and/or single band mode suppression. At least some known mode filters provide higher insertion loss for main mode and lower attenuation of other propagating modes than the presently disclosed techniques.

More particularly, the previously disclosed techniques have used one or a combination of the following features: dielectric materials and/or materials that are electromagnetically absorptive; resistive and/or lossy material as a coating for internal waveguide surfaces or as an internal load; iris-loaded multimode waveguides; coupling of absorptive waveguides/cavities, loaded with electromagnetically absorptive material, to an overmoded waveguide; provisions for specially designed and arranged leaking/radiating slots on a wall of an overmoded waveguide.

Relative to the above mentioned techniques, mode filters in accordance with the present disclosure provide similar or better mode suppression performance, in embodiments that are generally more compact, lighter weight, simpler to manufacture, and that avoid use of dielectric materials.

SUMMARY OF INVENTION

The present inventor has appreciated that a mode filter, exhibiting excellent mode suppression characteristics, may be configured as a compact, electrically conductive tube having a non-uniform internal cross-section. Advantageously, the mode filter may avoid the use of dielectric or non-conductive materials.

In an embodiment, a mode filter provides a low-loss transmission path for RF signals propagating in a first mode, while substantially suppressing at least one second mode. The mode filter includes a proximal port and a distal port, having a respective characteristic cross sectional dimension $D_{p1}$ and $D_{p2}$, and an electrically conductive hollow tube having a longitudinal axis and extending a length L between a distal end of the proximal port to a proximal end of the distal port. A cross section transverse to the longitudinal axis is non-uniform along length L and has a minimum internal characteristic dimension $D_{min}$ at least at a first longitudinal position and a maximum internal characteristic dimension $D_{max}$ at least at a second longitudinal position, $D_{min}$ being substantially different from $D_{max}$. The mode filter is configured to suppress the at least one second mode by at least 5 dB, and $D_{max}$ is less than 2.5 times the greater of $D_{p1}$ and $D_{p2}$.

In another embodiment, L may be less than three times the greater of $D_{p1}$ and $D_{p2}$. $D_{min}$ may be greater than one half the smaller of $D_{p1}$ and $D_{p2}$.

In a further embodiment, the mode filter is configured to suppress the at least one second mode by at least 20 dB, and $D_{max}$ is less than twice the greater of $D_{p1}$ and $D_{p2}$.

In an embodiment the mode filter is symmetric about the longitudinal axis. The cross section may be circular or square, for example.

In an embodiment, the mode filter has a return loss no worse than 15 dB.

In another embodiment, the mode filter is a monolithic component fabricated from an electrically conductive material. The mode filter may include no nonconductive or dielectric materials.

In a further embodiment, the mode filter substantially suppresses at least two undesired propagating modes.

In an embodiment, a mode filter provides a low-loss transmission path for RF signals propagating in a first mode, while substantially suppressing at least one second mode. The mode filter includes a proximal port and a distal port, having a respective characteristic cross sectional dimension $D_{p1}$ and $D_{p2}$, and an electrically conductive hollow tube having a longitudinal axis and extending a length L between a distal end of the proximal port to a proximal end of the distal port. A cross section transverse to the longitudinal axis is non-uniform along length L and has a minimum internal characteristic dimension $D_{min}$ at least at a first longitudinal position and a maximum internal characteristic dimension $D_{max}$ at least at a second longitudinal position, $D_{min}$ being substantially different from $D_{max}$. $D_{max}$ is larger than the greater of $D_{p1}$ and $D_{p2}$ and less than five times the greater of $D_{p1}$ and $D_{p2}$.

In an embodiment, an antenna system includes a waveguide, a radiating element, and mode filter, the mode filter communicatively coupled at a proximal end to the waveguide, and communicatively coupled at a distal end to the radiating element. The mode filter provides a low-loss transmission path for RF signals propagating in a first mode, while substantially suppressing at least one second mode. The mode filter includes a proximal port and a distal port, having a respective characteristic cross sectional dimension $D_{p1}$ and $D_{p2}$; and an electrically conductive hollow tube having a longitudinal axis and extending a length L between a distal end of the proximal port to a proximal end of the distal port. A cross section transverse to the longitudinal axis is non-uniform along length L and has a minimum internal characteristic dimension $D_{min}$ at least at a first longitudinal position and a maximum internal characteristic dimension $D_{max}$ at least at a second longitudinal position, $D_{min}$ being substantially different from $D_{max}$. The mode filter is configured to suppress the at least one second mode by at least 5 dB, and $D_{max}$ is less than 2.5 times the greater of $D_{p1}$ and $D_{p2}$.

BRIEF DESCRIPTION OF THE DRAWINGS

The included drawings are for illustrative purposes and serve only to provide examples of possible structures for the disclosed inventive filters and multiplexers. These drawings in no way limit any changes in form and detail that may be made by one skilled in the art without departing from the spirit and scope of the disclosed embodiments.

Figure 1B:
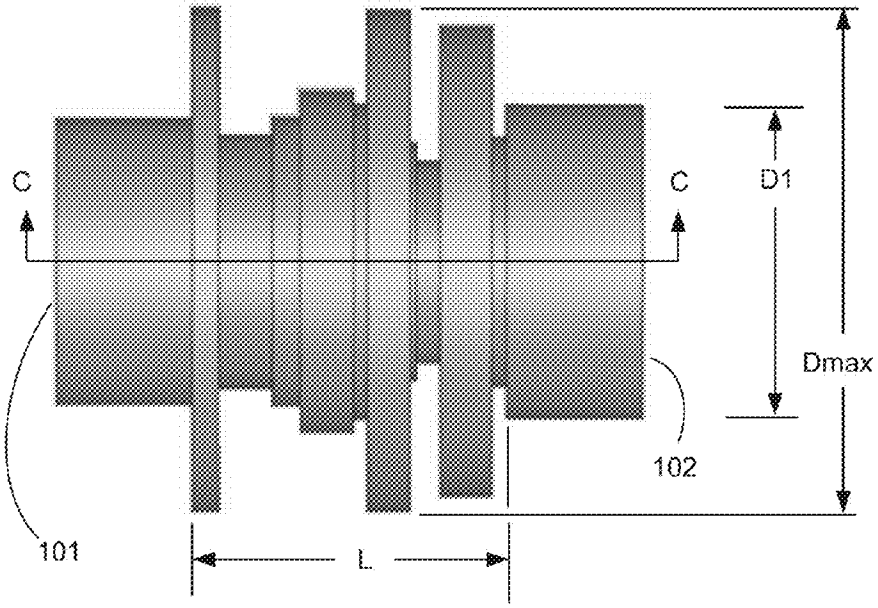
FIG. 1A, FIG. 1B, and FIG. 1C show, respectively a perspective view, a plan view, and a cross-sectional view of an example of a mode filter, according to an embodiment.

Throughout the drawings, the same reference numerals and characters, unless otherwise stated, are used to denote like features, elements, components, or portions of the illustrated embodiments. Moreover, while the subject invention will now be described in detail with reference to the drawings, the description is done in connection with the illustrative embodiments. It is intended that changes and modifications can be made to the described embodiments without departing from the true scope and spirit of the disclosed subject matter, as defined by the appended claims.

DETAILED DESCRIPTION

Specific exemplary embodiments of the invention will now be described with reference to the accompanying drawings. This invention may, however, be embodied in many different forms, and should not be construed as limited to the embodiments set forth herein. Rather, these embodiments are provided so that this disclosure will be thorough and complete, and will fully convey the scope of the invention to those skilled in the art.

It will be understood that when an element is referred to as being "connected" or "coupled" to another element, it can be directly connected or coupled to the other element, or intervening elements may be present. Furthermore, "connected" or "coupled" as used herein may include wirelessly connected or coupled. It will be understood that although the terms "first" and "second" are used herein to describe various elements, these elements should not be limited by these terms. These terms are used only to distinguish one element from another element. Thus, for example, a first user terminal could be termed a second user terminal, and similarly, a second user terminal may be termed a first user terminal without departing from the teachings of the present invention. As used herein, the term "and/or" includes any and all combinations of one or more of the associated listed items. The symbol "/" is also used as a shorthand notation for "and/or".

The terms "spacecraft", "satellite" and "vehicle" may be used interchangeably herein, and generally refer to any orbiting satellite or spacecraft system.

The term "characteristic cross sectional dimension", as used herein, and in the claims, means, with respect to a waveguide port having a circular, square, rectangular, elliptical or oval cross-section, a diameter of the circular cross section, a diagonal of the square or rectangular cross-section, and a major axis of the elliptical or oval cross-section, whether or not the waveguide is ridge-loaded, dielectric-loaded, or unloaded.

The present inventor has appreciated that a mode filter may be configured as a compact, electrically conductive device that provides a low-loss transmission path for RF signals propagating in a first mode, while substantially suppressing at least one second mode. As used herein, and in the claims, the terms "first mode" and "second mode" are used for convenience only to distinguish two different modes. It will be understood that the first mode may be a higher, or lower, order mode than the second mode. Advantageously, the mode filter may be a monolithic component fabricated exclusively from an electrically conductive material.

Figure 1A:
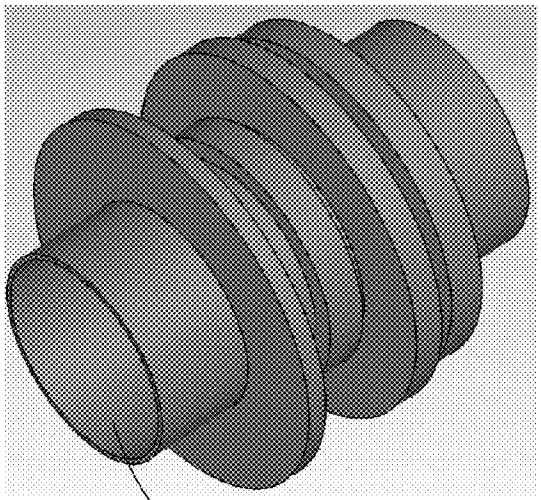
Figure 1C:
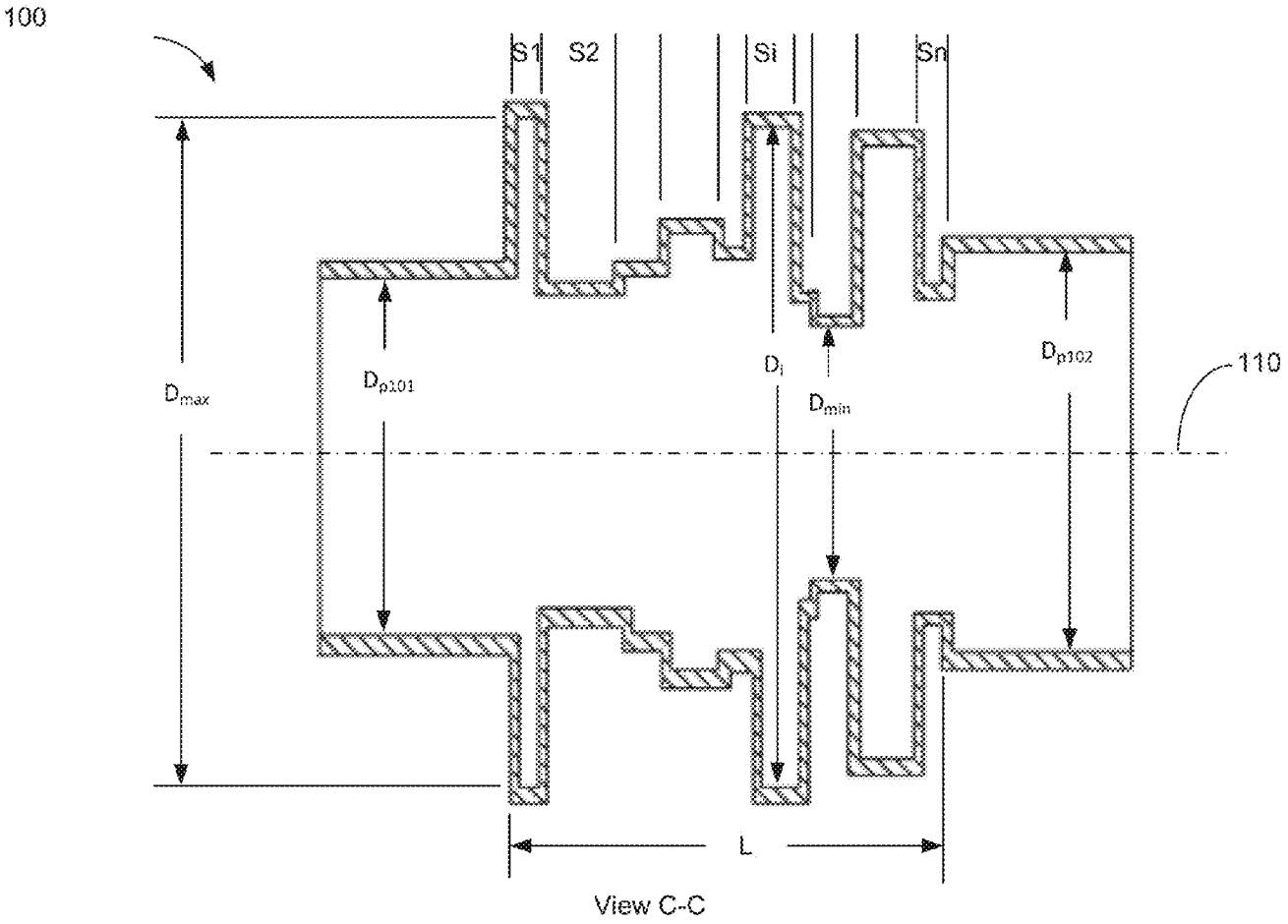

Referring now to FIG. 1A through 1C, an example embodiment of a mode filter 100 is illustrated. FIG. 1A illustrates an isometric view of mode filter 100, whereas FIG. 1B illustrates a plan view. FIG. 1C illustrates a sectional view taken along the line C-C of FIG. 1B. Mode filter 100 has a proximal end (or "port") 101 which may ordinarily be coupled, directly or indirectly, to a waveguide (not shown). The waveguide may be configured to couple RF signals between mode filter 100 and, for example, a feed network. Mode filter 100 has a distal end (or "port") 102 that may ordinarily be coupled with, for example, a horn antenna (not shown), or a waveguide communicatively coupled therewith, or a radiating feed element of an antenna system (not shown), or a waveguide communicatively coupled therewith. Mode filter 100 extends a length 'L' from a distal end of port 101 to a proximal end of port 102.

Referring now to FIG. 1C, it may be observed that mode filter 100 may be configured as a substantially hollow tube. Advantageously, mode filter 100 may be axisymmetric with respect to longitudinal axis 110 and may be fabricated from an electrically conductive material. Characteristic dimensions (diameters) $D_{p101}$ and $D_{p102}$ of, respectively, port 101 and port 102 are at least largely determined by the frequency band of the RF signals. In the illustrated implementation, for example, configured for dual band operation at a first frequency band of 11-12 GHz and a second frequency band of 14-15 GHz, diameters $D_{p101}$ and $D_{p102}$ may be approximately 0.8-0.9 inches.

In an embodiment, mode filter 100 is "compact" relative to characteristic dimensions of the equipment to which it is attached. For example, a maximum diameter $D_{max}$ of mode filter 100 may be less than, for example, 2.5 times the diameter of the larger of $D_{p101}$ and $D_{p102}$. Similarly, in an embodiment, L may be less than, for example, three times the diameter of the larger of $D_{p101}$ and $D_{p102}$.

In an embodiment, mode filter 100 may be configured to provide a low-loss transmission path for RF signals propagating in a $TE_{11}$ mode while substantially suppressing propagation of higher order modes. The present inventor has found that excellent mode suppression performance may be achieved by configuring mode filter 100 such that a cross section transverse to longitudinal axis 110 is substantially non-uniform. More particularly, in the illustrated example, along length 'L' of mode filter 100, a diameter $D_i$ of each segment $S_i$, other than $S_1$ and $S_n$, is different from a diameter of each respective adjacent segment $S_{i-1}$ and $S_{i+1}$. Segment $S_1$ has a diameter $D_1$ that is different from diameter $D_2$ and diameter $D_{p101}$; Segment $S_n$ has a diameter $D_n$ that is different from diameter $D_{n-1}$ and diameter $D_{p102}$. Values of $D_i$ may range, advantageously, between $D_1/2$ to $2.5 \times D_1$. Although in the illustrated embodiment, $D_{min}$ is less than both $D_{p101}$ and $D_{p102}$ this is not necessarily the case. In other embodiments, for example, $D_{min}$ may have a value intermediate to $D_{p101}$ and $D_{p102}$, or greater than both $D_{p101}$ and $D_{p102}$. In an embodiment $D_{max}$ is larger than the greater of $D_{p101}$ and $D_{p102}$ and less than five times the greater of $D_{p101}$ and $D_{p102}$.

A respective axial length of each of the various segments is, in the illustrated embodiment, also non-uniform, but this is not necessarily the case. It will be appreciated that optimizing techniques may be applied to determine a preferred number of segments, and the geometry, including respective axial length and diameter, of each segment, for a particular set of performance requirements. Performance analysis of the illustrated embodiment indicated better than 10 dB attenuation of $TM_{01}$ modes, while return loss of the dominant $TE_{11}$ mode was found to be considerably better than 30 dB.

In an embodiment, mode filter 100, may be fabricated from an electrically conductive material, for example, a metal. Advantageously, mode filter 100 may be formed as a monolithic component.

It will be appreciated that the foregoing description relates to a particular example arrangement and that the quantity of segments, and the respective geometry of each segment may vary substantially from the illustrated example. In the illustrated embodiment, for example, ten segments are provided, but this is not necessarily so. A greater or smaller number of segments (for example, one to nine segments, or eleven or more segments) is within the contemplation of the present disclosure. Moreover, the segments may not be orthogonal to the longitudinal axis, or of the particular shapes illustrated. It will be appreciated that the location and geometric features of the segments may be optimized through experiment or electromagnetic modeling.

Figure 2A:
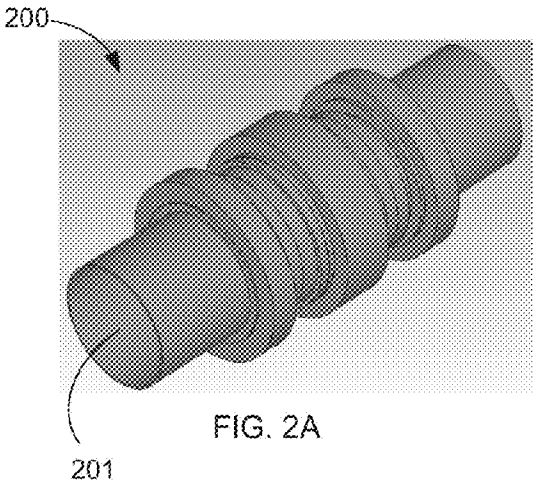
FIG. 2A and FIG. 2B show, respectively, a perspective view and a sectioned view of an example of a mode filter, according to a further embodiment.
Figure 2B:
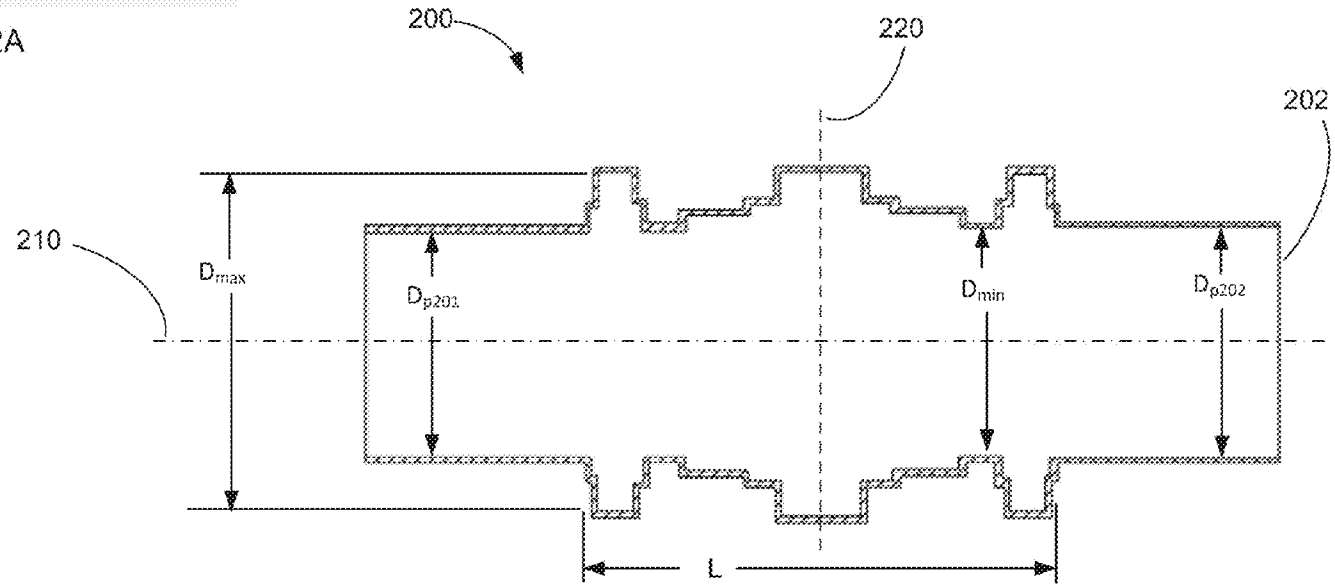

Referring now to FIG. 2A and FIG. 2B, a further example embodiment will be described. FIG. 2A illustrates a perspective view of mode filter 200, whereas FIG. 2B illustrates a sectional view. Mode filter 100 has a proximal port 201 which may ordinarily be coupled, directly or indirectly, to a waveguide (not shown) and a distal port 202. Distal port 202 may ordinarily be coupled with, for example, a horn antenna (not shown), or a waveguide communicatively coupled therewith, or a radiating feed element of an antenna system (not shown), or a waveguide communicatively coupled therewith. Mode filter 200 extends a length 'L' from a distal end of port 201 to a proximal end of port 202.

In the illustrated embodiment, mode filter 200 is configured as a substantially hollow tube. Advantageously, mode filter 200 may be axisymmetric with respect to longitudinal axis 210 and may be fabricated from an electrically conductive material. In the illustrated embodiment, a further plane of symmetry 220 exists at the midpoint of length L. Characteristic dimensions (diameters) $D_{p201}$ and $D_{p202}$ of, respectively, port 201 and port 202 are at least largely determined by the frequency band of the RF signals. In the illustrated implementation, for example, configured for dual band operation at a first frequency band of 3.4-3.7 GHz and a second frequency band of 6.4-6.7 GHz, diameters $D_{p101}$ and $D_{p102}$ may be approximately two inches.

As described above in relation to mode filter 100, mode filter 200 is "compact" relative to characteristic dimensions of the equipment to which it is attached. In the illustrated embodiment, it may be observed, for example, that a maximum diameter $D_{max}$ of mode filter 200 is less than 2.5 times the diameter of the larger of $D_{p201}$ and $D_{p202}$. Similarly, L is less than three times the diameter of the larger of $D_{p201}$ and $D_{p202}$.

Figure 3A:
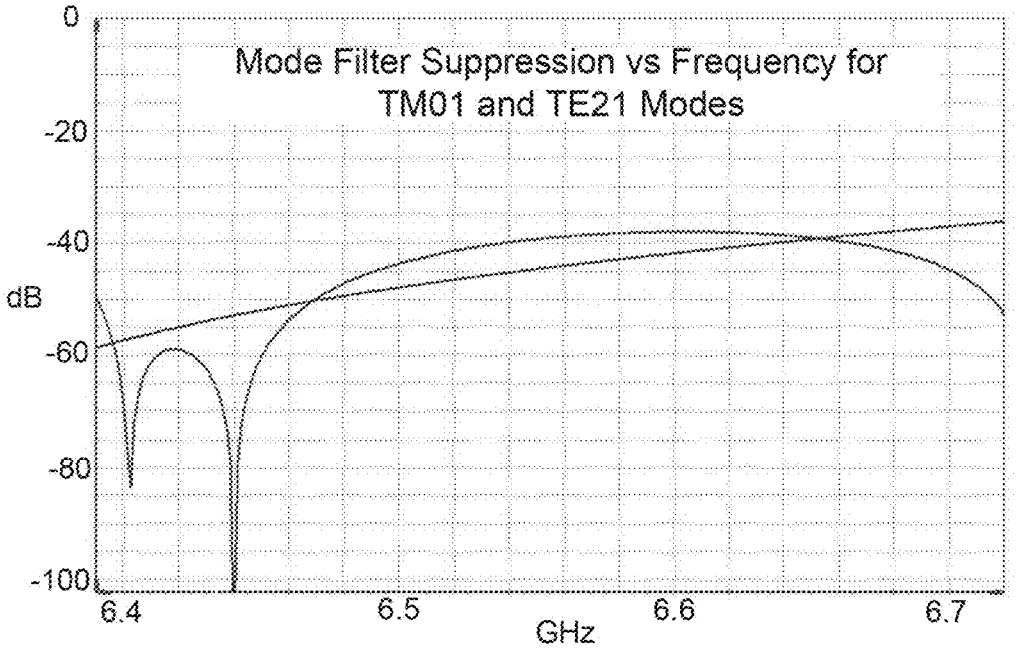
FIG. 3A and FIG. 3B show example plots of performance of a mode filter mode according to an embodiment.
Figure 3B:
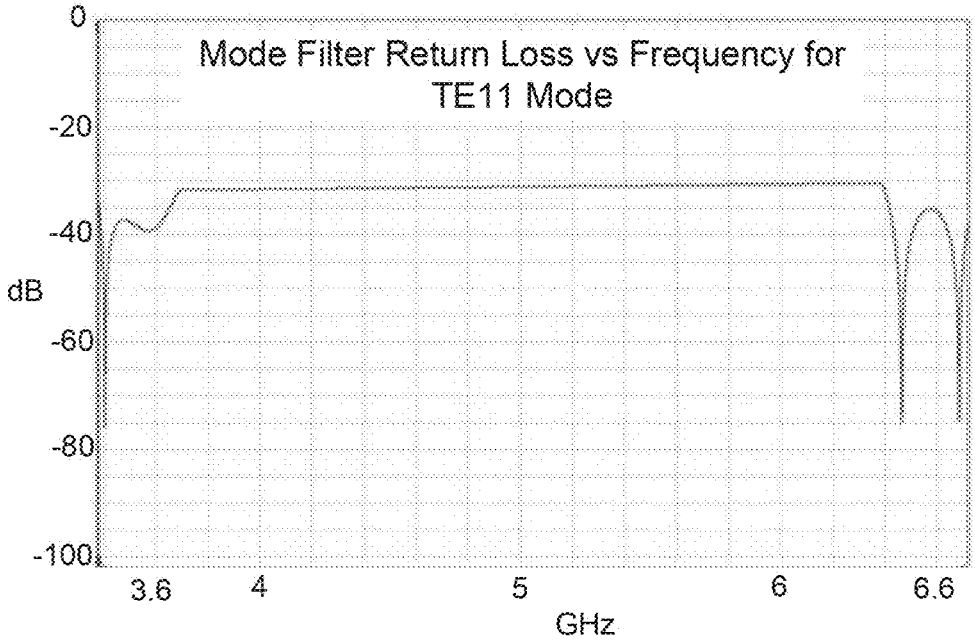

In an embodiment, mode filter 200 may be configured to provide a low-loss transmission path for RF signals propagating in a $TE_{11}$ mode, while substantially suppressing propagation of higher order modes and providing excellent return loss for the $TE_{11}$ mode signals over both the first and second frequency bands. As illustrated, respectively, in FIG. 3A and FIG. 3B, performance analysis of the illustrated embodiment indicated better than 35 dB attenuation of higher order TE modes, while return loss of the dominant $TE_{11}$ mode was never less than 30 dB.

The above mentioned performance was achieved by configuring mode filter 200 such that a cross section transverse to longitudinal axis 210 is substantially non-uniform. A diameter of each of a number of adjacent segments varies in a range between $D_{min}$ and $D_{max}$. In an embodiment, $D_{max}$ may be less than 2.5 times the diameter of the larger of $D_{p101}$ and $D_{p102}$. Advantageously, $D_{max}$ may be less than twice the diameter of the larger of $D_{p101}$ and $D_{p102}$, whereas $D_{min}$ may be no smaller than one half the smaller larger of $D_{p101}$ and $D_{p102}$. Although in the illustrated embodiment, $D_{min}$ is approximately equal to both $D_{p102}$ and $D_{p102}$ this is not necessarily the case.

Figure 4:
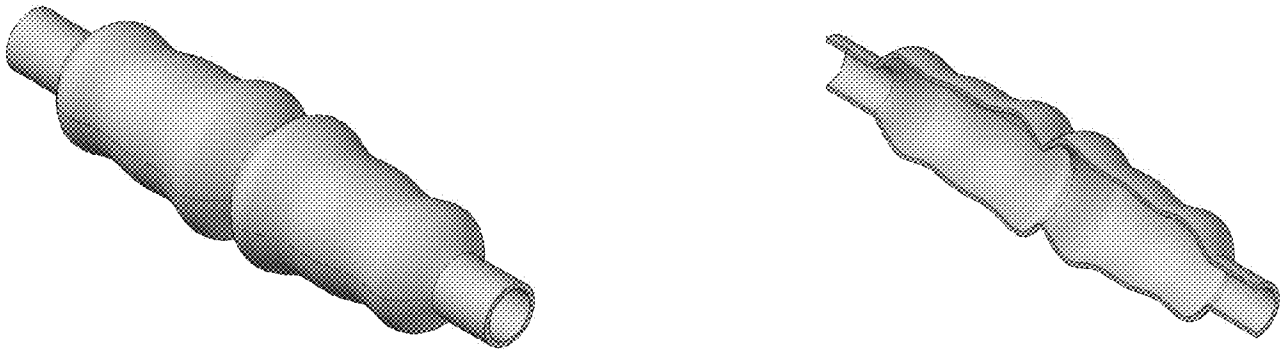
FIG. 4 shows an example of a perspective view and a sectioned view of a mode filter, according to another embodiment.
Figure 5:
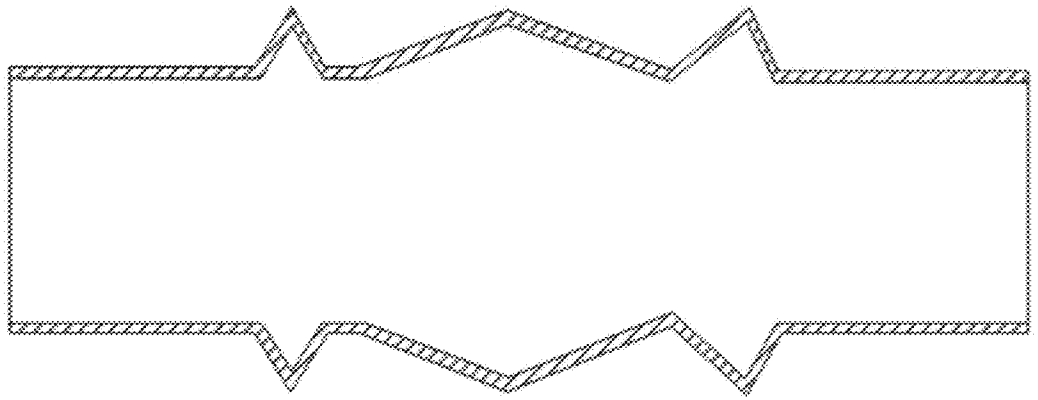
FIG. 5 shows a cross-sectional view of an example of a mode filter, according to another embodiment.

In the embodiments described above, adjacent segments of the mode filters are separated by abrupt 90 degree "steps", that is each part of the external wall of the mode filter is illustrated as being either parallel to or orthogonal to a longitudinal axis. The above-mentioned feature may be avoided, in some embodiments. Referring now to FIG. 4, a perspective and cross sectional view of an example of an embodiment is illustrated where each segment has a curvilinear aspect, and transitions between segments are smooth. It is also within the contemplation of the present disclosure that segments may be characterized by conical walls, as illustrated in FIG. 5 cross sectional view. For any of the above-mentioned embodiments, a transition between any two adjacent segments may be smooth or stepped. That is, the mode filter may have a smooth internal profile throughout its length, or only stepped transitions between adjacent segments, or any mixture of smooth transitions and stepped transitions between segments.

Figure 6:
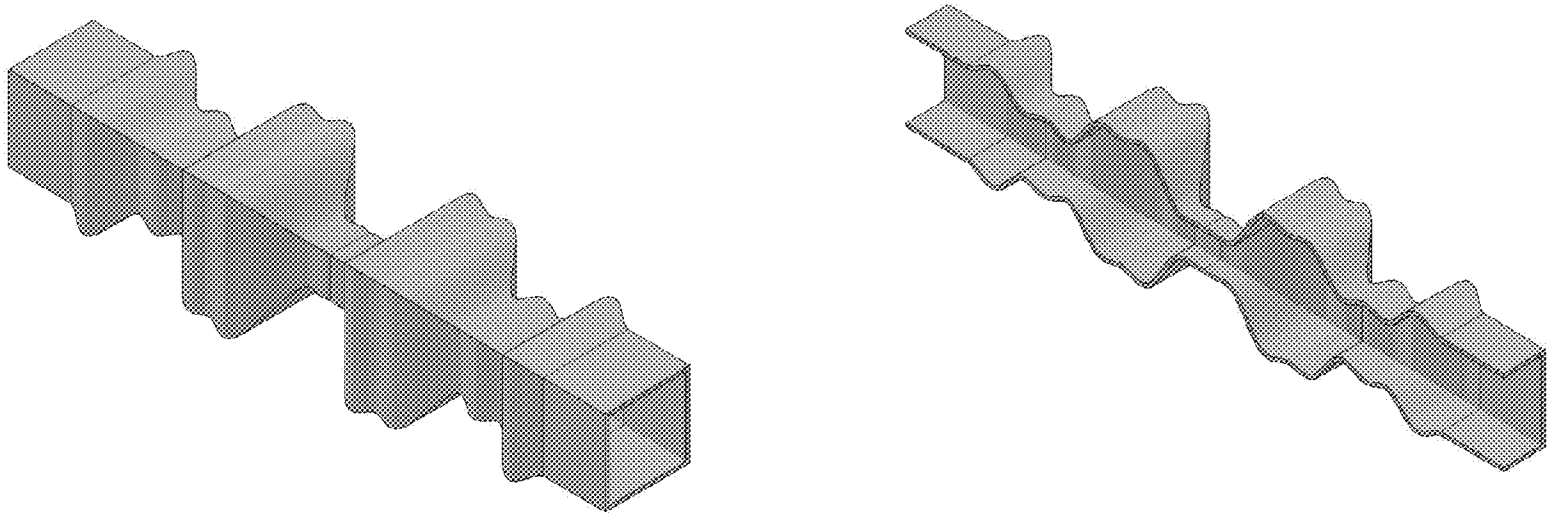
FIG. 6 shows an example of a perspective view and a cross-sectional view of a mode filter, according to another embodiment.

In the embodiments described above, mode filters having a circular cross section have been described. In some applications, however, a square or rectangular cross section may be desirable. In FIG. 6, mention perspective and cross section for example a mode filter designed in accordance with the principles of the present disclosure and having a square cross section is illustrated. Moreover, a mode filter according to the present disclosure may be configured to be coupled to any type, size or shape of waveguide, including, but not limited to those having a circular, oval, square, or rectangular cross-section, and the waveguide may be ridge-loaded, dielectric loaded, or unloaded. It should also be noted that each of a proximal and a distal port of the mode filter may not only have a respectively different characteristic dimension, but may also have a different shape. For example, the proximal port may have a circular cross-section, while the distal port may have a square cross-section.

Thus, an improved mode filter has been described. While various embodiments have been described herein, it should be understood that they have been presented by way of example only, and not limitation. It will thus be appreciated that those skilled in the art will be able to devise numerous systems and methods which, although not explicitly shown or described herein, embody said principles of the invention and are thus within the spirit and scope of the invention as defined by the following claims.

What is claimed is:

1. An apparatus comprising:

a mode filter configured as a monolithic component fabricated from an electrically conductive material, the mode filter providing a low-loss transmission path for RF signals propagating, at a first frequency band, in a first one or more propagating modes, while suppressing, by at least 5 dB, at least one second propagating mode of the RF signals associated with the first frequency band;

a proximal port and a distal port, having a respective characteristic cross sectional dimension $D_{p1}$ and $D_{p2}$; and an electrically conductive hollow tube, the hollow tube having a longitudinal axis and including a plurality of non ridge-loaded adjacent longitudinal segments, the hollow tube extending, by way of the plurality of non ridge-loaded adjacent longitudinal segments, a length L between a distal end of the proximal port to a proximal end of the distal port, wherein:

the mode filter is a monolithic component fabricated from an electrically conductive material;

a cross section transverse to the longitudinal axis is corrugated along length L and has a minimum external characteristic dimension $D_{min}$ along at least a first longitudinal segment of the plurality of adjacent longitudinal segments and a maximum external characteristic dimension $D_{max}$ along at least a second longitudinal segment of the plurality of adjacent longitudinal segments, $D_{min}$ being substantially different from $D_{max}$; and $D_{max}$ is larger than the greater $D_{p1}$ and $D_{p2}$ and less than twice the greater of $D_{p1}$ and $D_{p2}$.

2. The apparatus of claim 1, wherein L is less than three times the greater of $D_{p1}$ and $D_{p2}$.

3. The apparatus of claim 1, wherein $D_{min}$ is greater than one half the smaller of $D_{p1}$ and $D_{p2}$.

4. The apparatus of claim 1, wherein the mode filter is configured to suppress the at least one second mode by at least 20 dB, and $D_{max}$ is less than twice the greater of $D_{p1}$ and $D_{p2}$.

5. The apparatus of claim 1, wherein the mode filter is symmetric about the longitudinal axis.

6. The apparatus of claim 1, wherein the cross section is circular.

7. The apparatus of claim 1, wherein the cross section is square.

8. The apparatus of claim 1, wherein the mode filter has a return loss no worse than 15 dB.

9. The apparatus of claim 1, wherein the mode filter includes no nonconductive or dielectric materials.

10. The apparatus of claim 1, wherein the mode filter substantially suppresses at least two undesired propagating modes.

11. A mode filter comprising:

a proximal port and a distal port, having a respective characteristic cross sectional dimension $D_{p1}$ and $D_{p2}$; and an electrically conductive hollow tube, the hollow tube having a longitudinal axis and including a plurality of non ridge-loaded adjacent longitudinal segments, the hollow tube extending, by way of the plurality of non ridge-loaded adjacent longitudinal segments, a length L between a distal end of the proximal port to a proximal end of the distal port, wherein:

the mode filter is a monolithic component fabricated from an electrically conductive material;

a cross section transverse to the longitudinal axis is corrugated along length L and has a minimum external characteristic dimension $D_{min}$ at least a first longitudinal segment of the plurality of adjacent longitudinal segments and a maximum external characteristic dimension $D_{max}$ along at least at a second longitudinal segment of the plurality of adjacent longitudinal segments, $D_{min}$ being substantially different from $D_{max}$;

$D_{max}$ is larger than the greater of $D_{p1}$ and $D_{p2}$ and less than twice the greater of $D_{p1}$ and $D_{p2}$; and the mode filter is configured to provide a low-loss transmission path for RF signals propagating, at a first frequency band, in a first one or more propagating modes, while suppressing, by at least 5 dB, at least one second propagating mode of the RF signals associated with the first frequency band.

12. An antenna system comprising a waveguide, a radiating element, and a mode filter, the mode filter communicatively coupled at a proximal end to the waveguide, and communicatively coupled at a distal end to the radiating element, wherein:

the mode filter is a monolithic component fabricated from an electrically conductive material; and the mode filter provides a low-loss transmission path for RF signals propagating, at a first frequency band, in a first one or more propagating modes, while suppressing, by at least 5 dB, at least one second propagating mode of the RF signals associated with the first frequency band, the mode filter comprising:

a proximal port and a distal port, having a respective characteristic cross sectional dimension $D_{p1}$ and $D_{p2}$; and an electrically conductive hollow tube, the hollow tube having a longitudinal axis and including a plurality of non ridge-loaded adjacent longitudinal segments, the hollow tube extending, by way of the plurality of non ridge-loaded adjacent longitudinal segments, a length L between a distal end of the proximal port to a proximal end of the distal port, wherein a cross section transverse to the longitudinal axis is corrugated along length L and has a minimum external characteristic dimension $D_{min}$ along at least at a first longitudinal segment of the plurality of adjacent longitudinal segments and a maximum external characteristic dimension $D_{max}$ along at least a second longitudinal segment of the plurality of adjacent longitudinal segments, $D_{min}$ being substantially different from $D_{max}$, and $D_{max}$ being larger than the greater of $D_{p1}$ and $D_{p2}$ and less than twice the greater of $D_{p1}$ and $D_{p2}$.

13. The apparatus of claim 12, wherein L is less than three times the greater of $D_{p1}$ and $D_{p2}$.

14. The apparatus of claim 12, wherein $D_{min}$ is greater than one half the smaller of $D_{p1}$ and $D_{p2}$.

15. The apparatus of claim 12, wherein the mode filter is symmetric about the longitudinal axis.

16. The apparatus of claim 12, wherein the mode filter has a return loss no worse than 15 dB.

17. The apparatus of claim 12, wherein the mode filter includes no nonconductive or dielectric materials.

18. The apparatus of claim 12, wherein the mode filter substantially suppresses at least two undesired propagating modes.

* * * * *